US008965035B2

(12) United States Patent
Lee

(10) Patent No.: US 8,965,035 B2
(45) Date of Patent: Feb. 24, 2015

(54) THIN SPEAKER STRUCTURE

(71) Applicant: Fortune Grand Technology Inc., Taoyuan County (TW)

(72) Inventor: Ping-Yu Lee, Taoyuan County (TW)

(73) Assignee: Fortune Grand Technology Inc., Taoyuan County (TW)

( * ) Notice: Subject to any disclaimer, the term of this patent is extended or adjusted under 35 U.S.C. 154(b) by 0 days.

(21) Appl. No.: 14/019,904

(22) Filed: Sep. 6, 2013

(65) Prior Publication Data

US 2015/0016658 A1 Jan. 15, 2015

(30) Foreign Application Priority Data

Jul. 15, 2013 (TW) ..... 102125312 A

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 3/00*** | (2006.01) |

(52) U.S. Cl.

CPC ... *H04R 1/00* (2013.01); *H04R 3/00* (2013.01)
USPC ..... 381/412; 381/423

(58) Field of Classification Search

USPC ..... 381/386, 396, 398, 400–403, 412, 421, 381/423, 431; 181/148, 153, 198, 199
See application file for complete search history.

(56) References Cited

U.S. PATENT DOCUMENTS

| | | | | |
|---|---|---|---|---|
| 2006/0078153 | A1* | 4/2006 | Sato | 381/404 |
| 2007/0187172 | A1* | 8/2007 | Kaneda et al. | 181/181 |
| 2010/0092011 | A1* | 4/2010 | Windischberger et al. | 381/190 |
| 2012/0152648 | A1* | 6/2012 | Hiwatashi | 181/148 |

* cited by examiner

*Primary Examiner* — Tuan D Nguyen
(74) *Attorney, Agent, or Firm* — Rosenberg, Klein & Lee

(57) ABSTRACT

A thin speaker structure comprises: a long support frame; a magnetic circuit member; a voice coil; a membrane; wherein the magnetic circuit member and voice coil are rounded and the membrane includes an elliptic surrounding and an elliptic body with a center portion and a peripheral portion; the peripheral portion is fixed to a bottom edge of an inner surface of the surrounding and the center portion corresponding to the peripheral portion defines a rigid strengthened region in a longer elliptic shape; the center portion has a length of a long side longer than a diameter of the voice coil at a predetermined distance; whereby the elliptic body is combined with the circular voice coil to form a vibrating structure in order to increase the rigidity of the membrane.

9 Claims, 6 Drawing Sheets

THIN SPEAKER STRUCTURE

BACKGROUND OF THE INVENTION

1. Field of the Invention

The invention relates to a thin speaker structure, particularly to a speaker body that can improve the rigidity of a membrane and suppress the segmental vibration of the membrane.

2. Description of the Related Art

The traditional moving-coil speaker is mainly rounded. A conventional round speaker 70 as shown in FIG. 1A includes a round voice coil and a magnetic circuit element 72 arranged below a membrane 71. The membrane 71 and the voice coil are proportional concentric circles. When the membrane 71 is axially moved up and down by the voice coil, each point affected by forces on the membrane 71 is the same, resulting in the best sound quality.

However, when the consumer electronic products are required to be thin and light, the space provided for the speaker is very limited. Sometimes, the position of the speaker is often set in a corner in order to accommodate the demand for ultra-thin consumer electronic products such as mobile phones, tablet computers or notebook computers (NB) with rectangular appearances. Also, the speaker is required to meet the demand of good sound quality and volume and thus many thin speakers are produced in non-circular shapes, as shown in FIGS. 1B and 1C, the speaker structure is set into an elliptic shape.

In FIG. 1B, a conventional elliptic speaker 80, a normal speaker body using in the consumer electronic products, includes an elliptic membrane 81 with a body and a surrounding, an elliptic voice coil 81 arranged below the membrane 81, and an elliptic magnetic circuit element 82. The membrane 81 has a center portion 811 smaller than the voice coil and is set to be in an elliptic or polygonal shape. Comparing to the round structure, when the area of the membrane 81 of the elliptic or polygonal structure is increased, the volume increased and the bass response is better. But the disadvantage is that the voice coil and the magnetic circuit element 82 are ellipses and thus the material costs increase a lot and the production process are more complicated.

In order to solve the costs and production process problems of the elliptic speaker 80, a conventional elliptic speaker 90 as shown in FIG. 1C provides a round center portion 911 of a membrane 91, a round voice coil, and a round magnetic circuit element 92 wherein a diameter of the voice coil is longer or equal than or to a diameter of the center portion 911.

The above structure has advantage of reducing the material costs and production process. Due to the smaller magnetic circuit element 92, there are more sound chamber spaces behind the speaker for increasing resonated spaces and enhancing the bass and volume. However, the round voice coil and the elliptic membrane 91 leads to different forces on the short side and long side of the membrane 91 when the voice coil vibrates; so that the long edges is easy to generate a radial segmental vibration resulting in poor performance in middle level frequency (MLF), and distortion. The MLF is one of the most sensitive areas of sound for humans, so poor MLF performance will affect the evaluation of consumer for speakers. Moreover, this structure usually provides a concave membrane in order to reduce the above MLF problems and reduce the segmental vibration movement of the membrane but this result leads to an overall increase in the thickness of the speaker, not meeting the needs of slim consumer electronic products.

In view of the aforementioned, problems, the inventor of the present invention conducted researches and experiments and developed a thin speaker structure to overcome the problems of the prior art.

SUMMARY OF THE INVENTION

It is a first object of the present invention to provide a thin speaker structure to strengthen the rigidity of an elliptic body and reduce the radial segmental vibration of a long side of the membrane, having good sound performances in middle level frequency (MLF).

It is a second object of the present invention to provide a thin speaker structure to increase the space behind the speaker body for increasing the resonance space, improving the sound quality and volume.

It is a third object of the present invention to provide a thin speaker structure to diminish the amount of the magnetic circuit member, reducing the material costs.

It is a last object of the present invention to provide a thin speaker structure to use a circular voice coil, having convenient production process and better production yield and efficiency.

In order to achieve the above objects, a thin speaker structure comprises: a long support frame having a hollow portion in a center thereof and an elliptic step surface formed at a periphery thereof; a magnetic circuit member arranged in the hollow portion; a voice coil installed in the magnetic circuit member; a membrane arranged at an upper edge portion of the voice coil and an external periphery thereof fixed on the elliptic step surface to form a basic speaker structure; wherein the hollow portion, the magnetic circuit member and the voice coil are in circular shapes; and the membrane includes an elliptic surrounding and an elliptic body having a center portion and a peripheral portion; the peripheral portion is fixed to a bottom edge of an inner surface of the surrounding and the center portion corresponding to the peripheral portion defines a rigid strengthened region in a longer elliptic shape; the center portion has a length of a long side longer than a diameter of the voice coil at a predetermined distance;

whereby the elliptic body is combined with the circular voice coil 30 to form a vibrating structure in order to increase the rigidity of the membrane to reduce the radial segmental vibration of a long side of the membrane.

Based on the features disclosed, the peripheral portion at a long side of the elliptic body corresponding to the diameter of the voice coil has an outward flange in a predetermined shape to form a connecting portion for combining with the upper edge portion of the voice coil. In the preferred embodiment, the flange corresponding to the voice coil is set to be in an arc-shape for the connecting portion having the same circular contour with the voice coil.

Further, the center portion of the elliptic body has a flat upper surface or has an upper surface set in a recessed arc-shape or in a convex arc-shape.

Further, the surrounding has long sides in parallel and short sides in symmetrical arc-shapes; the center portion of the elliptic body corresponding to the surrounding is set to be in an elliptic shape.

DETAILED DESCRIPTION OF THE PREFERRED EMBODIMENT

Figure 1A:
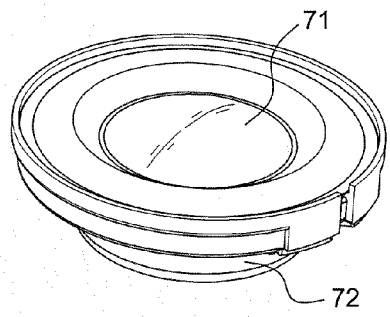
FIG.1A PRIOR ART
FIG. 1A is a schematic view of a conventional round speaker structure.
Figure 1B:
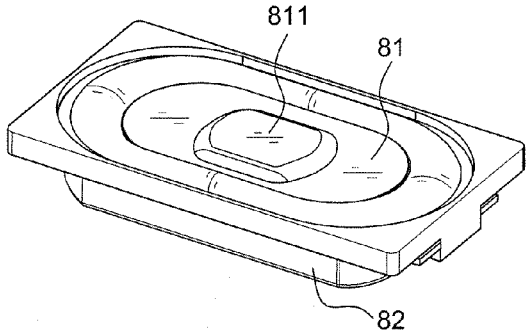
FIG.1B PRIOR ART
FIG. 1B is a schematic view of a conventional elliptic speaker structure.

Referring to FIGS. 2 through 9, the preferred embodiment of a thin speaker structure 60 in accordance with the present invention comprises the following components as discussed in detail below.

A long support frame 10 has a hollow portion 11 in a center thereof and the support frame 10 has a terminal board 13 at a bottom side thereof. A magnetic circuit member 20 arranged in the hollow portion 11 may include a yoke 21, a magnet 22 and a plate 23 but it is not a limitation. An annular gap 24 between the yoke 21 and the magnet 22 is provided for installing a voice coil 30.

A membrane 40 is arranged at an upper edge portion 31 of the voice coil 30 and an external periphery thereof is fixed on the elliptic step surface 12 to form a basic speaker structure. However, the above features are prior arts and therefore will not be described in details here.

The present invention is characterized in that the membrane 40 includes an elliptic surrounding 41 and an elliptic body 42 having a center portion 421 and a peripheral portion 422; the peripheral portion 422 is fixed to a bottom edge of an inner surface of the surrounding 41 and the center portion 421 corresponding to the peripheral portion 422 defines a rigid strengthened region in a longer elliptic shape; the center portion 421 has a length L of a long side longer than a diameter of the voice coil 30 at a predetermined distance; whereby the elliptic body 42 is combined with the circular voice coil 30 to form a vibrating structure in order to increase the rigidity of the membrane 40 to reduce the radial segmental vibration of a long side of the membrane 40.

To effectively define the rigid strengthened region in a longer elliptic shape, the length L of the long side of the center portion 421 must be longer than the diameter D of the voice coil 30 at a predetermined distance. In the preferred embodiment, the length L of the long side of the center portion 421 is longer than the diameter D of the voice coil 30 at least 1.5 times in order to achieve the best effect on reducing the segmental vibration of the membrane 40. The thickness of the design of the thin speaker structure 60 can be controlled below 10 mm for the total height of the thin speaker structure 60 fully complying with the current consumer electronics product design requirements.

Figure 4:
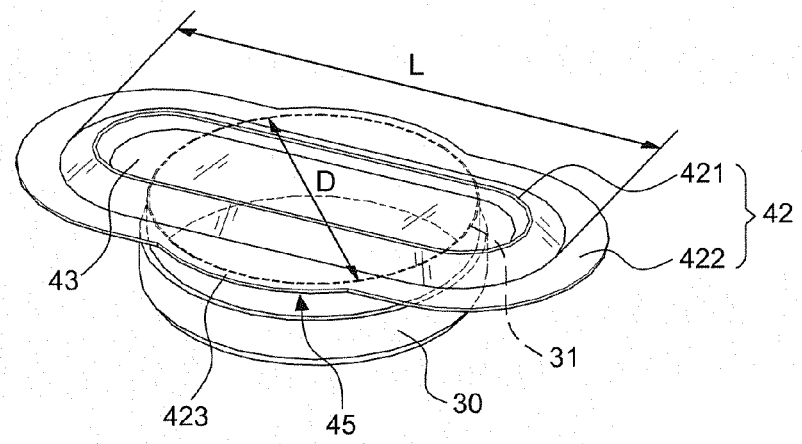
FIG. 4 is a schematic view of the body and voice coil structure of the present invention.

With the referenced to FIG. 4, the peripheral portion 422 at a long side of the elliptic body 42 corresponding to the diameter D of the voice coil 30 has an outward flange 423 in a predetermined shape to form a connecting portion 45 for combining with the upper edge portion 31 of the voice coil 30. In the preferring embodiment, the flange 423 corresponding to the voice coil 30 is set to be in an arc-shape for the connecting portion 45 having the same circular contour with the voice coil 30, such that the voice coil 30 can be tightly combined with the membrane 40. In practical, the voice coil 30 can be bonded to the peripheral portion 422 of the short side of the body 42 or the flange 423 but some parts of the center portion 421 cannot be bonded to the voice coil 30; therefore, the glue or magnetic fluid is provided.

Figure 5:
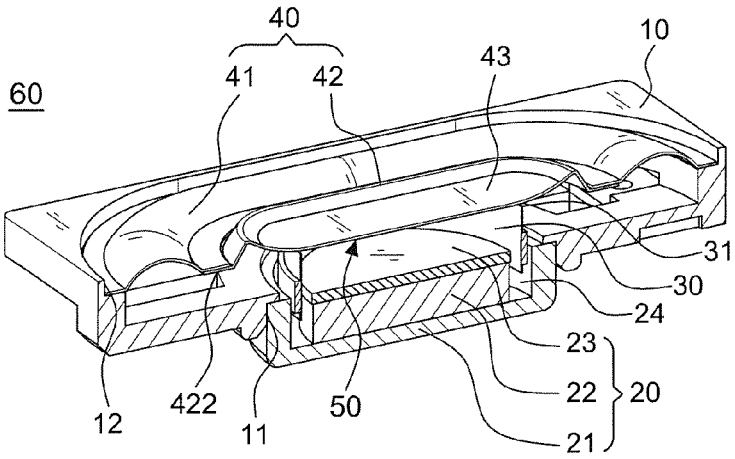
FIG. 5 is a sectional view of a long side of the present invention.
Figure 6:
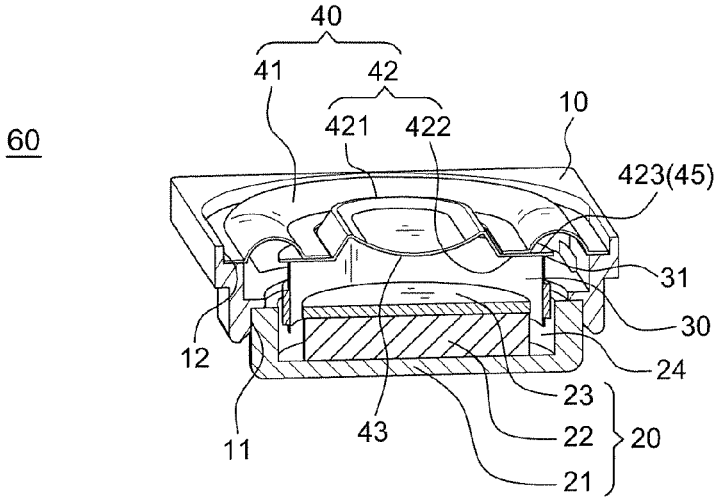
FIG. 6 is a sectional view of a short side of the present invention.
Figure 7:
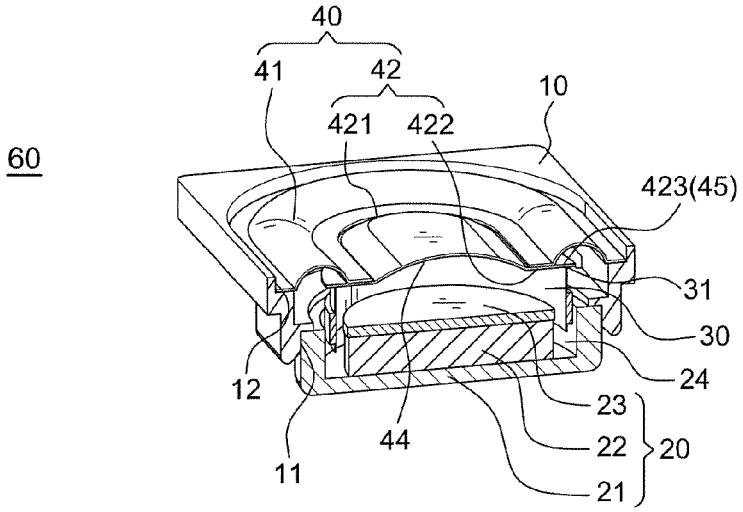
FIG. 7 is a sectional view of a short side of the body in accordance with another embodiment of the present invention.

The center portion 421 of the elliptic body 42 has a flat upper surface. In FIGS. 5 and 6, the center portion 421 of the elliptic body 42 has an upper surface set in a recessed arc-shape 43. In FIG. 7, the center portion 421 of the elliptic body 42 has an upper surface set in a convex arc-shape 44. Whether the upper surface of the center portion 421 is in the recessed arc-shape 43 or convex arc-shape 44, they help increasing the rigidity of the membrane 40. In the preferred embodiment, the center portion 421 and the peripheral portion 422 may be made of the same materials and integrated together or may be made of different materials and are bonded by a glue. Moreover, the surrounding 41 and the elliptic body 42 usually made of different materials are bonded by a glue for bonding to the peripheral portion 422.

In the preferred embodiment, the surrounding 41 has long sides 411 in parallel and short sides in symmetrical arc-shapes; the center portion 421 of the elliptic body 42 corresponding to the surrounding 41 is set to be in an elliptic shape.

Figure 1C:
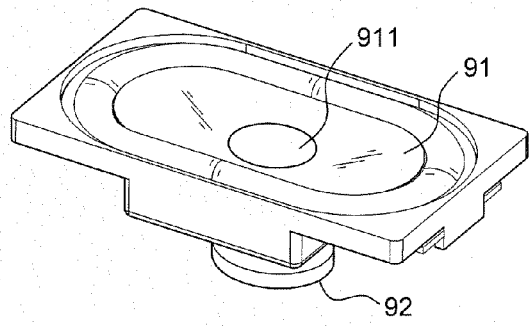
FIG.1C PRIOR ART
FIG. 1C is schematic view of another conventional elliptic speaker structure.
Figure 2:
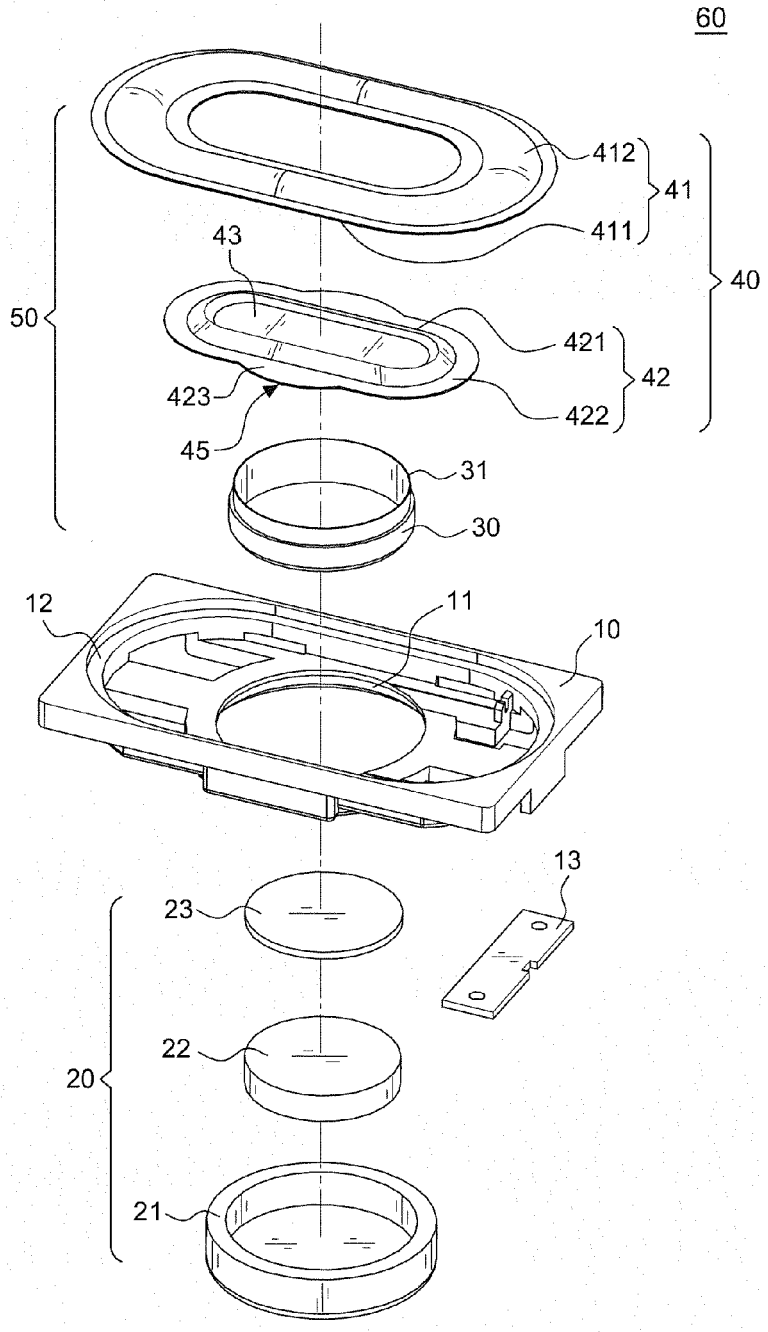
FIG. 2 is an exploded perspective view of the preferred embodiment in accordance with the present invention.
Figure 3:
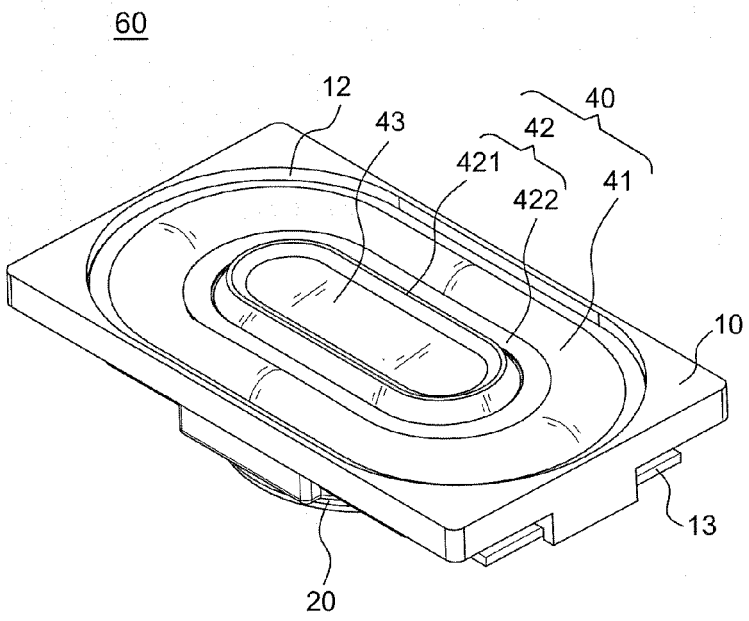
FIG. 3 is an assembly perspective view of the preferred embodiment in accordance with the present invention.
Figure 9:
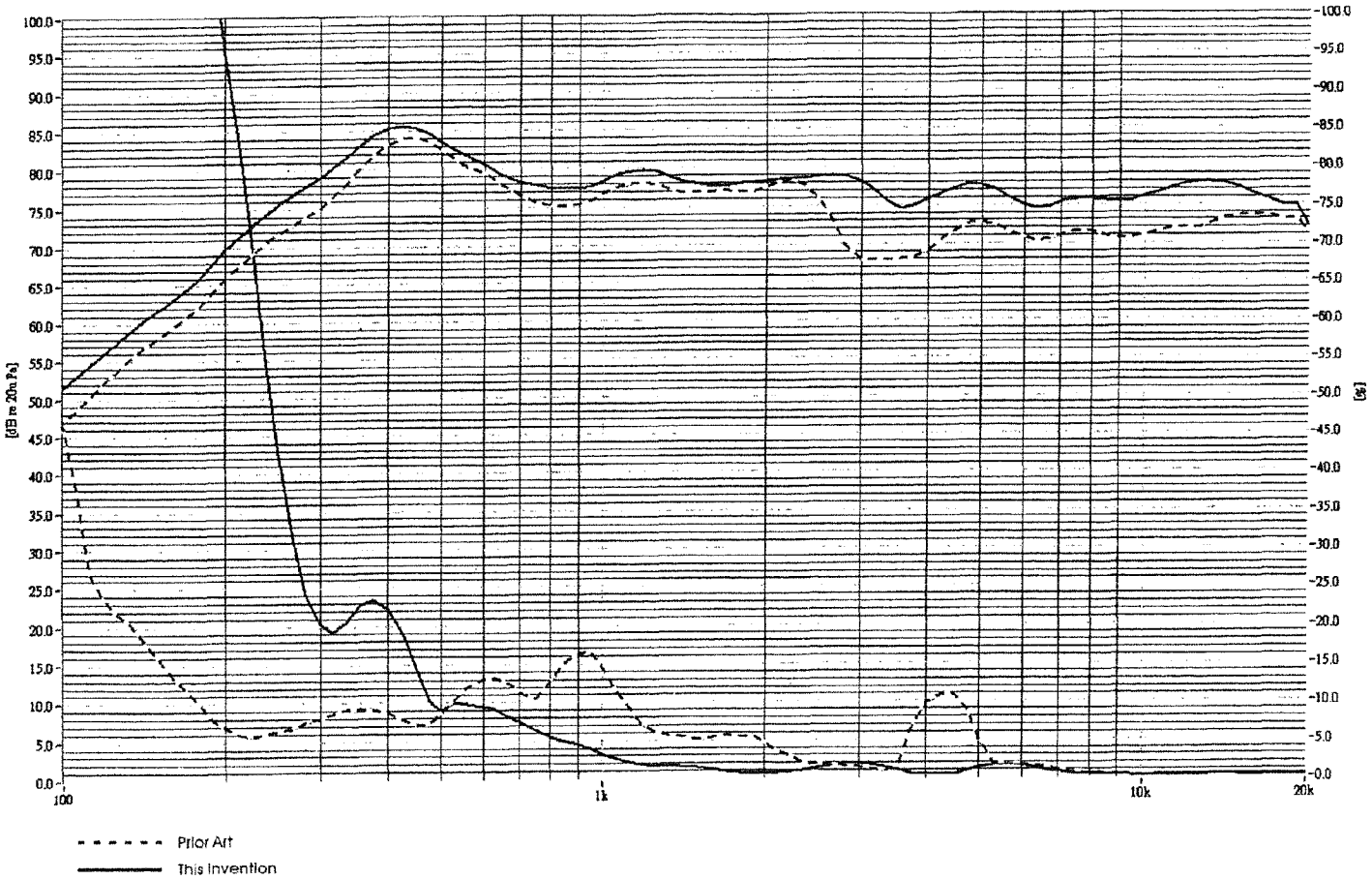

In summation of the description above, the present invention has the following advantages:

1. The rigidity of the body 42 strengthened for the center portion 421 of the body 42 is in the elliptic shape, solving poor sound performance in middle level frequency (MLF) and distortion problems resulting from the segmental vibration generated by a circular center portion of a conventional body. FIG. 9 is a comparison chart showing the measured data of the present invention and a conventional elliptic speaker 90 in FIG. 1C. In FIG. 9, the broken line represents the conventional elliptic speaker 90. Obviously, the volume falls down quickly at 2 KHz resulting in an about 10 dB volume drop between 2 KHz~3 KHz and up to 10% of the distortion between 3 KHz~5 KHz, indicating that the MLF performance is poorer. As for the solid line which represents the present invention, the result of the comparison clearly shows that the present invention without obvious drop has better performance in MLF performance. Moreover, comparison chart shows that the distortion of the conventional elliptic speaker 90 between 3 KHz~5 KHz is up to 10%, but the present invention is less than 2%. Thus, the present invention improves the problems of the prior art.

Figure 8:
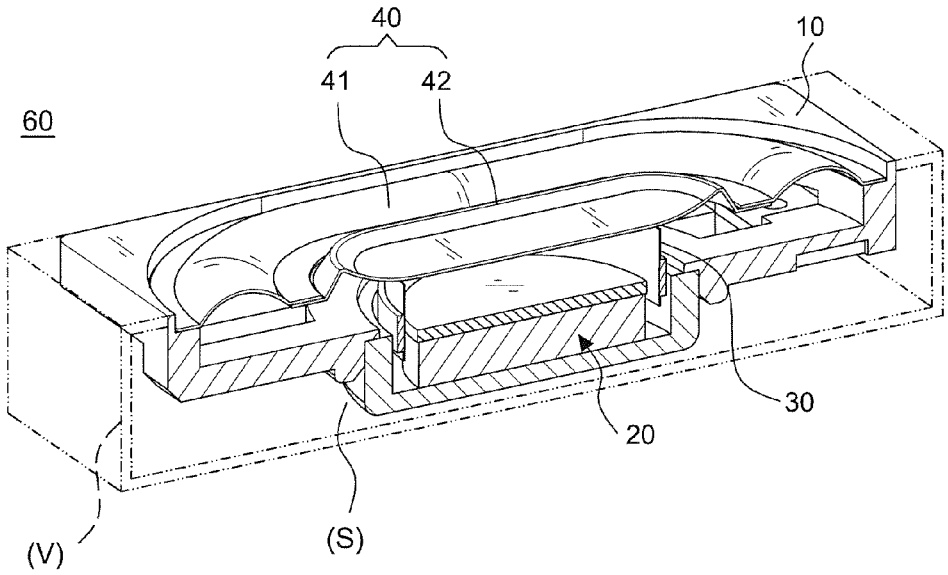
FIG. 8 is an example of the present invention using in a sound chamber; and, FIG. 9 is a measured comparison chart of the conventional elliptic speaker and the present invention.

2. Since the magnetic circuit member 20 as shown in FIG. 8 is in the circular shape, the space behind the speaker body increases and the resonance space S with design of the sound chamber V increases to improve the sound quality and volume. Further, the total height of the speaker body can be controlled below 10 mm, providing space for applications in electronics.

3. The amount of the magnetic circuit member 20 is reduced and thus the present invention solves the problem of increasing the costs of a conventional elliptic magnetic circuit member.

4. As a result of the circular voice coil 30, the production process is not as complicated as the conventional elliptic voice coil, providing better production yield and efficiency.

In order to clearly analyze and illustrate the differences of structure and performance between the present invention and the conventional speaker, comparison listed as below:

Comparison Chart of the Prior Arts and the Present Invention

| Product | Voice coil/ Magnetic circuit member | Membrane | Center portion of body | Effect comparison |
|---|---|---|---|---|
| Prior art A | Circular shape | Circular shape | Circular shape | Good sound quality, but not fully complying with the current consumer electronics product design requirements |
| Prior art B | Elliptic shape | Elliptic shape | Elliptic or polygonal shape | ① large area of membrane, but the volume of magnetic circuit member will occupy the sound chamber resonance space ② Increasing in the cost of the magnetic circular member and voice coil, and having complex production process |
| Prior art C | Circular shape | Elliptic shape | Circular shape | ① Varies force on the short side and long side of the membrance for generating the segmental vibration of the long side to be easily distorted, resulting in poor performance of the MLF ② Concave design of the membrane, leading to thickening of the speaker not complying with the current consumer requirements of thin electronics product |
| The present invention | Circular shape | Elliptic shape | Elliptic shape | ① Good rigidity of the long side of the membrane, reducing the segmental vibration and speaker distortion and having good performance of the MLF ② circular magnetic circuit member, increasing the resonance space and enhancing the sound quality and volume ③ less amount of magnetic circuit member, reducing the costs; circular voice coil, providing better production yield and efficiency |

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A thin speaker structure, especially to a thin speaker body with a full height less than 10 mm, comprising:

a long support frame having a hollow portion in a center thereof and an elliptic step surface formed at a periphery thereof;

a magnetic circuit member arranged in the hollow portion;

a voice coil installed in the magnetic circuit member;

a membrane arranged at an upper edge portion of the voice coil and an external periphery thereof fixed on the elliptic step surface to form a basic speaker structure;

wherein the hollow portion, the magnetic circuit member and the voice coil are in circular shapes; and the membrane includes an elliptic surrounding and an elliptic body having a center portion and a peripheral portion; the peripheral portion is fixed to a bottom edge of an inner surface of the surrounding and the center portion corresponding to the peripheral portion defines a rigid strengthened region in a longer elliptic shape; the center portion has a length of a long side longer than a diameter of the voice coil at a predetermined distance;

whereby the elliptic body is combined with the circular voice coil to form a vibrating structure in order to increase the rigidity of the membrane to reduce the radial segmented vibration of a long side of the membrane.

2. The thin speaker structure as claimed in claim 1, wherein the peripheral portion at a long side of the elliptic body corresponding to the diameter of the voice coil has an outward flange in a predetermined shape to form a connecting portion for combining with the upper edge portion of the voice coil.

3. The thin speaker structure as claimed in claim 2, wherein the flange corresponding to the voice coil is set to be in an arc-shape for the connecting portion having the same circular contour with the voice coil.

4. The thin speaker structure as claimed in claim 1, wherein the length of the long side of the center portion is longer than the diameter of the voice coil at least 1.5 times.

5. The thin speaker structure as claimed in claim 1, wherein the center portion of the elliptic body has an upper surface set in a recessed arc-shape.

6. The thin speaker structure as claimed in claim 1, wherein the center portion of the elliptic body has an upper surface set in a convex arc-shape.

7. The thin speaker structure as claimed in claim 1, wherein the center portion of the elliptic body has a flat upper surface.

8. The thin speaker structure as claimed in claim 1, wherein the surrounding has long sides in parallel and short sides in symmetrical arc-shapes; the center portion of the elliptic body corresponding to the surrounding is set to be in an elliptic shape.

9. The thin speaker structure as claimed in claim 1, wherein the magnetic circuit member includes at least a yoke, at least a magnet and at least a plate, and an annular gap between the yoke and the magnet is provided for installing the voice coil.

* * * * *